United States Patent [19]

Larsen et al.

[11] 3,969,056

[45] July 13, 1976

[54] MACHINE FOR SURFACE TREATMENT OF CONCRETE PANELS OR SECTIONS

[75] Inventors: Rasmus Andreas Larsen, Rungsted Kyst; Axel Nielsen, Copenhagen, both of Denmark

[73] Assignee: Larsen & Nielsen Enterprise A/S, Birkerod, Denmark

[22] Filed: Feb. 5, 1975

[21] Appl. No.: 547,307

Related U.S. Application Data

[63] Continuation-in-part of Ser. No. 232,547, March 7, 1972.

[30] Foreign Application Priority Data

Mar. 9, 1971 Denmark ..... 1086/71

[52] U.S. Cl. ..... 425/218; 404/106; 404/118

[51] Int. Cl.[2] ..... B28B 17/00

[58] Field of Search ..... 404/106, 93, 118, 10, 404/119, 120, 114, 113; 264/34; 425/218

[56] References Cited

UNITED STATES PATENTS

| | | | |
|---|---|---|---|
| 1,234,984 | 7/1917 | Walker | 404/113 |
| 1,390,479 | 9/1921 | Baker | 404/120 |
| 1,410,114 | 3/1922 | Peterson | 404/113 X |
| 1,565,657 | 12/1925 | Lichtenberg | 404/113 |
| 1,817,687 | 8/1931 | Heztzez | 404/120 |
| 2,042,156 | 5/1936 | McCrery | 404/114 |
| 2,362,490 | 11/1944 | Lewis | 404/98 |
| 2,754,732 | 7/1956 | Beyer | 404/120 |
| 3,182,572 | 5/1965 | Kubala | 404/119 |
| 3,681,484 | 8/1972 | McKie | 404/114 X |
| 3,817,644 | 6/1974 | Matson | 404/114 |

*Primary Examiner*—Byers, Jr., Nile C.
*Attorney, Agent, or Firm*—Beveridge, DeGrandi, Kline & Lunsford

[57] ABSTRACT

A machine is disclosed for finishing the surface of a cast concrete unit supported in a mold frame. Opposed vertical supports on opposite sides of the mold frame are movable on longitudinal tracks, and they support transverse support means which are vertically adjustable. Concrete finishing belts and vibratory means are supported on each transverse support means. The belts on different transverse support means are driven in opposite directions and the vibratory means are separately driven.

9 Claims, 6 Drawing Figures

MACHINE FOR SURFACE TREATMENT OF CONCRETE PANELS OR SECTIONS

This is a continuation-in-part of application Ser. No. 232,547, filed Mar. 7, 1972.

The invention relates to a machine for surface treatment of horizontally cast concrete units, such as walls, partitions, and floor decks, which are used in the erection of prefabricated houses and which are cast in form having lateral boundaries, the top edges of which are flush with the upper surface of the concrete unit. The purpose of the treatment is to finish the surface by smoothing it to make it completely even, porous-free and if desired by finally glazing it.

Machines are known for the construction of concrete roads, which machines by travelling in the road direction smooth a layer of poured concrete in the whole width of the road section in question in a level with or somewhat higher than the top side of lateral boundary rails or corresponding battens for the poured concrete, which may then be compacted by the gradual movement of a vibration beam across the entire surface, so that the surface will be flush with the top side of the lateral boundaries. The final smoothing and repair, if any, of the surface is then made by pulling a band of a suitable material, extended across the entire width, repeatedly forwards and backwards, gradually moving same in the longitudinal direction of the road, repairing at the same time cavities, if any, by application of rendering or mortar. The reciprocating movement of the smoothing band serves among other things for smoothing possible scratches in the surface due to the incidental occurrence of coarse grains in the surface layer, such grains being eventually immersed into the concrete. Finally the surface is often treated with a broom-like device to make it sufficiently rough.

Such machines may advantageously be used in road building, but the homogenity and density of the surface obtained and the compaction provided by the vibration, if any, may hardly meet the requirements generally laid down for prefabricated structural concrete panels.

An object of the invention is to provide a machine of the kind mentioned in the introduction, in which the manual work usually required for finishing the cast concrete units has been taken over by the machine, and which on a mere mechanical basis may provide a particularly uniform compaction and an entirely smooth and dense surface, so that the machine is particularly fit in the manufacture of prefabricated concrete structural components.

According to the invention the machine comprises a horizontal rectangular framework, vertical supports on opposite sides of said framework, wheels mounted in said vertical supports for movement of said framework along parallel tracks disposed under each said vertical supports, vertically adjustable support means mounted on said framework and extending between said vertical supports, spaced rollers mounted in said vertically adjustable support means, parallel endless belts passing over said rollers driven in mutually opposite directions, a mold frame mounted beneath said horizontal framework containing a cast concrete unit to be finished, sides on said mold frame parallel to said vertical supports, said mold frame sides of greater width than the cast concrete unit, a lower end of each endless belt, said lower end spanning at least the entire width between said mold frame sides and overlying the surface of the cast concrete unit, support plates between said belts directing said belts downward against the surface of the cast concrete unit, and separately driven means to vibrate said support plates substantially perpendicular to the surface of the cast concrete unit.

At the subsequent smoothing by the endless bands driven in mutually opposite directions possible scratches in the surface will get smoothed and when the supporting means for each band are adjustable in relation to for instance the thickness of the band and the elasticity of its material the pressure of the band on the surface may be adjusted to any desired amount.

According to the invention the supporting plate for each endless band may be suspended by resilient means whereby it is urged downwardly by gravity but may be moved upwards against the action of the resilient means.

The utilization of this suspension type meets the inconvenience caused by the fact that the surface of the deposited mass in the beginning locally may be higher than the top edge of the lateral boundaries of the form.

The endless bands will be directed at right angles to the direction of travel.

In order to achieve a vibration compaction of the concrete during the smoothing of the surface by means of the bands, each of the supporting plates for the lower part of the two bands is connected with a separately driven vibration mechanism comprising more vibrator units arranged evenly distributed along the plate.

When the cast unit to be finished should have just an even surface, the desired finish may be obtained by means of the smoothing belts. This is often the case when the cast unit is a portion wall which later should be painted or covered with wall paper.

When however the cast unit has been cast with coarse aggregates and is to be used for walls the smoothing is effected by the smoothing belts while they are acted upon by the vibration means, which, when started, compact the smoothed surface.

The compaction thereby achieved may have one or two effects, one being that capillary water is forced up to the treated surface. Another being a shrinkage of the surface layer which means that the surface sinks below the level of the upper edges of the form.

In order to meet these effects a hopper for supplying a small quantity of rendering preferably an earth-dry cement-water mixture is mounted in the framework. The discharge slot of the hopper being located in front of the foremost of the smoothing belts.

For special purposes it is desirable that the finished surface of the cast unit is not only even, smooth, and non-porous, but also has a velvet appearance. Such appearance may be achieved by means of steel glazing plates, known per se, mounted in the framework behind the smoothing belts. Each plate extending the entire width of the cast unit and being suspended in such a way that it during the travel of the framework along the length of the unit is pressed gently down against the smooth surface of the cast unit.

In order to avoid any scouring effect of the endless belts when their lower runs pass over the width of the cast unit while the framework travels along the length of the unit guide means are mounted for raising the edges of the belts from the surface to be treated.

Preferably the support plates are correspondingly curved so that the raised edges of the belts are forced slightly against the curved portions by the guide means.

The machine according to the invention preferably is constructed in such a manner that its individual operation components as vibration means, rendering hopper and glazing plate may be put out of function one by one or applied one by one or in any desired combination.

For a better understanding of the present invention and for further objects and advantages thereof reference is now made to the following description in conjunction with the accompanying drawings in which.

Figure 1:
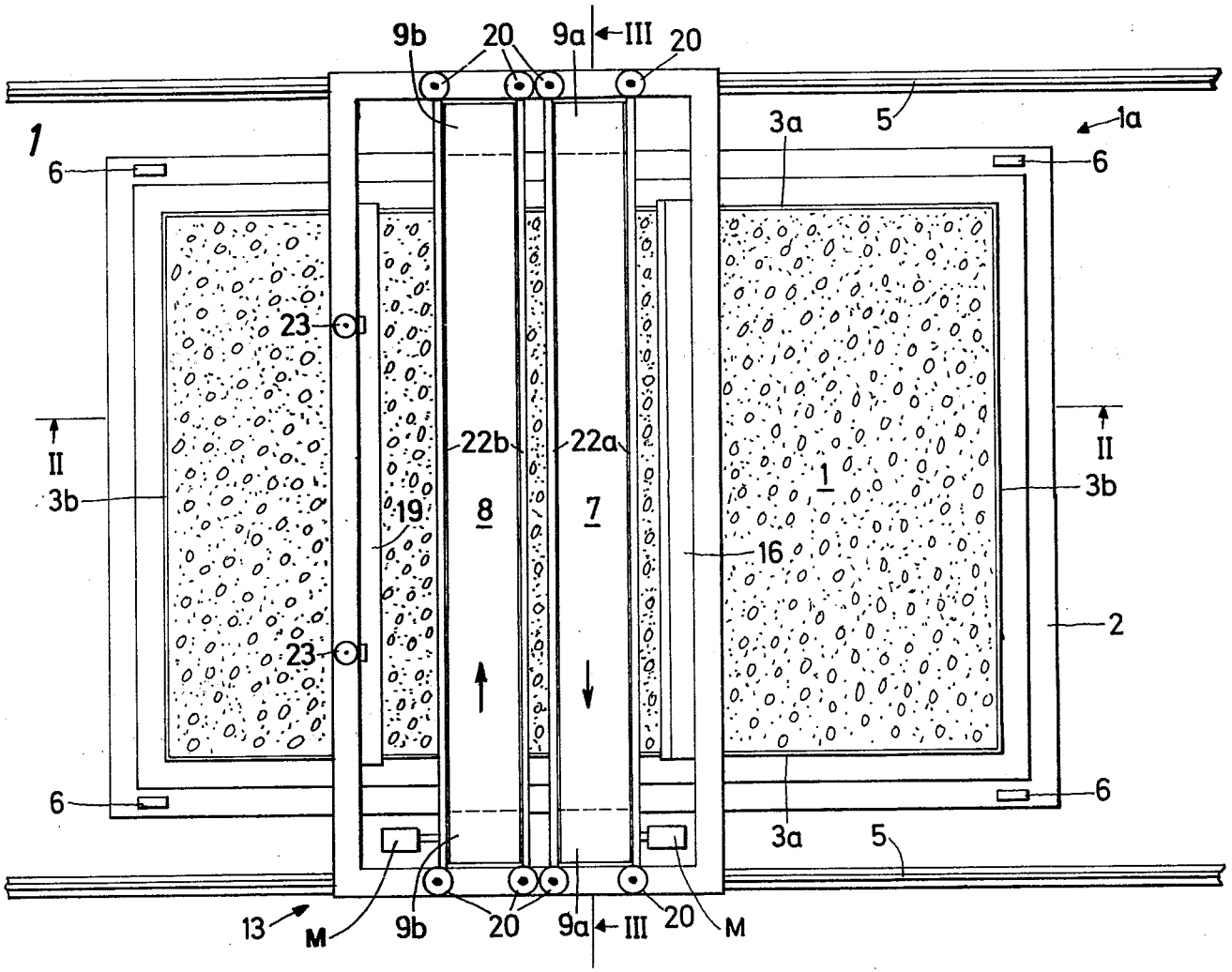
FIG. 1 is a schematical top view of the machine of the invention.
Figure 2:
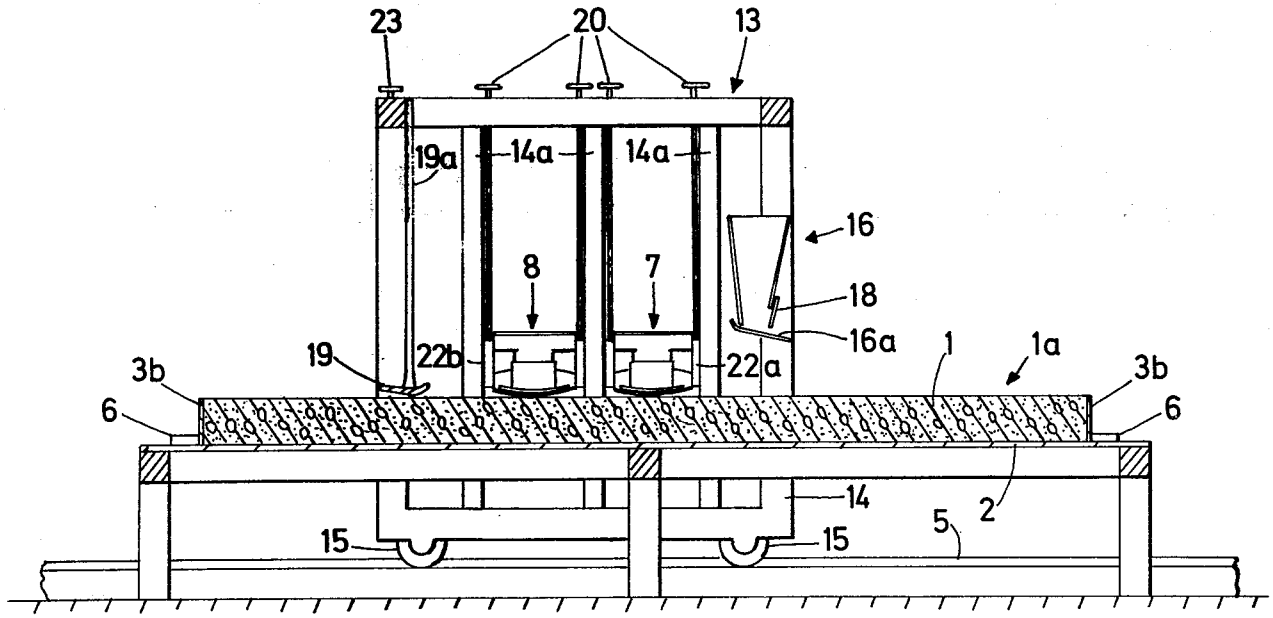
FIG. 2 is a sectional view along the lines II—II of FIG. 1.
Figure 3:
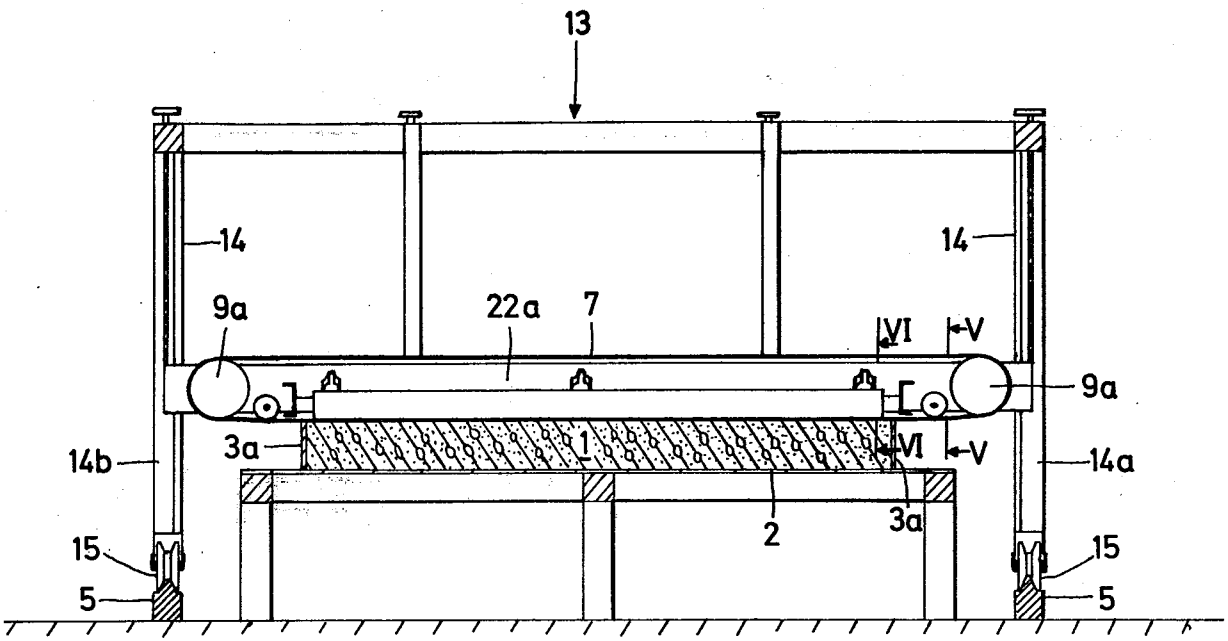
FIG. 3 is a sectional view along the lines III—III of FIG. 1.

In the drawings are mainly shown the parts which are necessary for the comprehension of the invention.

A concrete mass 1 has been poured into a form 1*a* comprising a bottom 2 with a mold frame having lateral sides 3*a* and end sides 3*b*, the horizontally smooth top edges of the sides corresponding to the desired surface level of the finished concrete unit.

During the pouring of the cement mixture in the form vibrators have been acting on metal plates 6 fixed on the bottom 2 beyond the sides 3*a*.

The bottom 2 is resting upon supports between a pair of parallel ground rails 5. A horizontal rectangular framework 13 is carried by vertical support frames 14 and at the lower ends of the supports 14 wheels 15 are mounted so that the framework 13 can be moved across the form 1*a* parallel to the lateral sides 3*a*.

In each of the supporting frames vertical support beams 14*a* and 14*b* are mounted forming vertical guides for two pairs of transverse beams 22*a* and 22*b*, the height position of which are adjusted in a manner known per se by handwheels 20.

Between each pair of beams 22*a* and 22*b* endless rubber belts 7 and 8 respectively are mounted, each carried by a pair of rollers 9*a* and 9*b* respectively.

At each end of the belts 7 and 8 the rollers 9*a* and 9*b* rotate on axle shafts extending between the pairs of beams 22*a* and 22*b*. The axle shafts are positioned in such a manner that the free lower runs of the belts end in the space between the lateral mold frame sides 3*a* and the support frames 14. The belts 7 and 8 are driven in mutually opposite directions, each of the driving rollers of the roller sets 9*a*,9*a* and 9*b*,9*b* respectively being driven separately by motors M, shown diagrammatically in FIG. 1.

Figure 4:
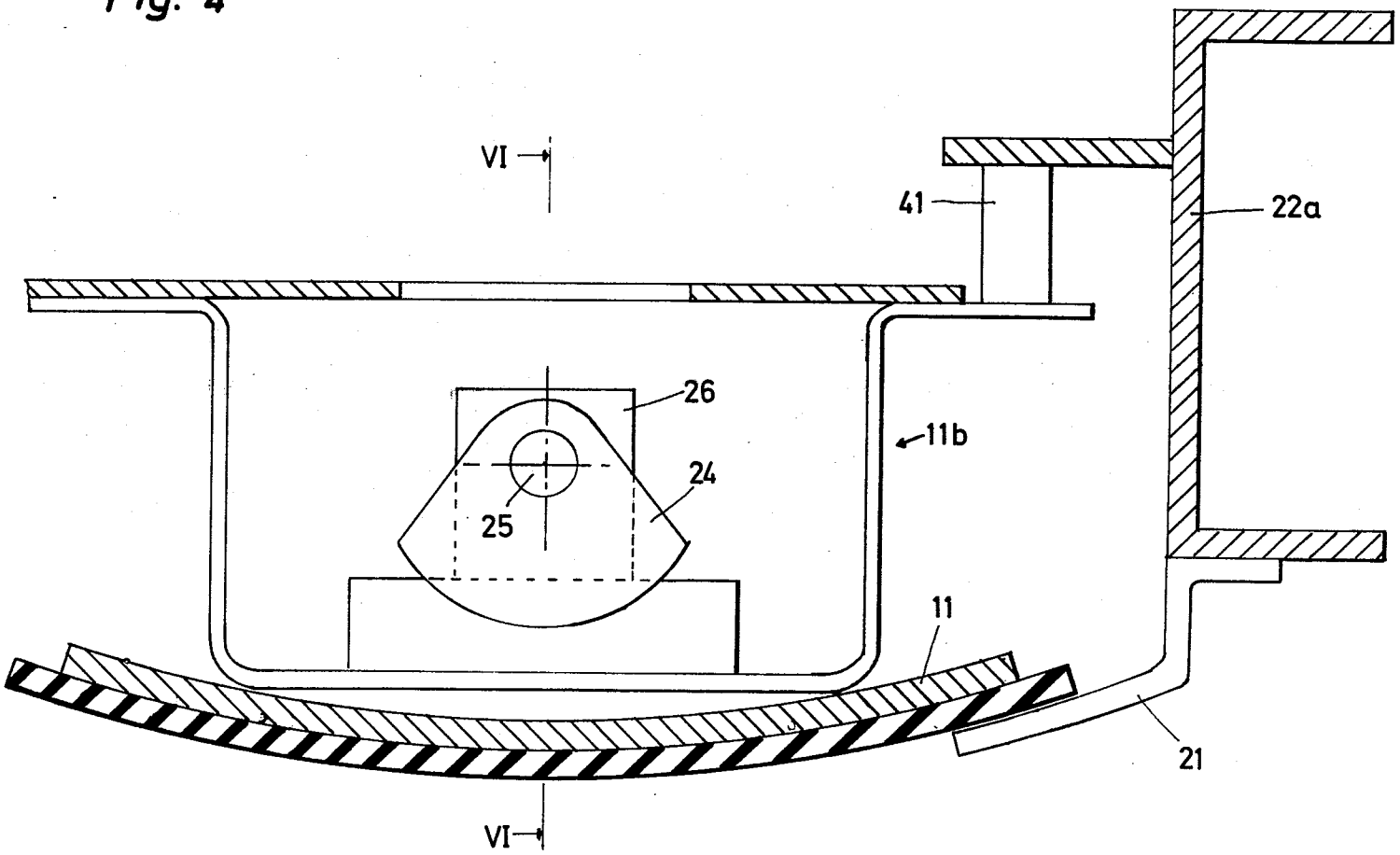
FIG. 4 is a fragmentary sectional view along the lines IV—IV of FIG. 3.
Figure 6:
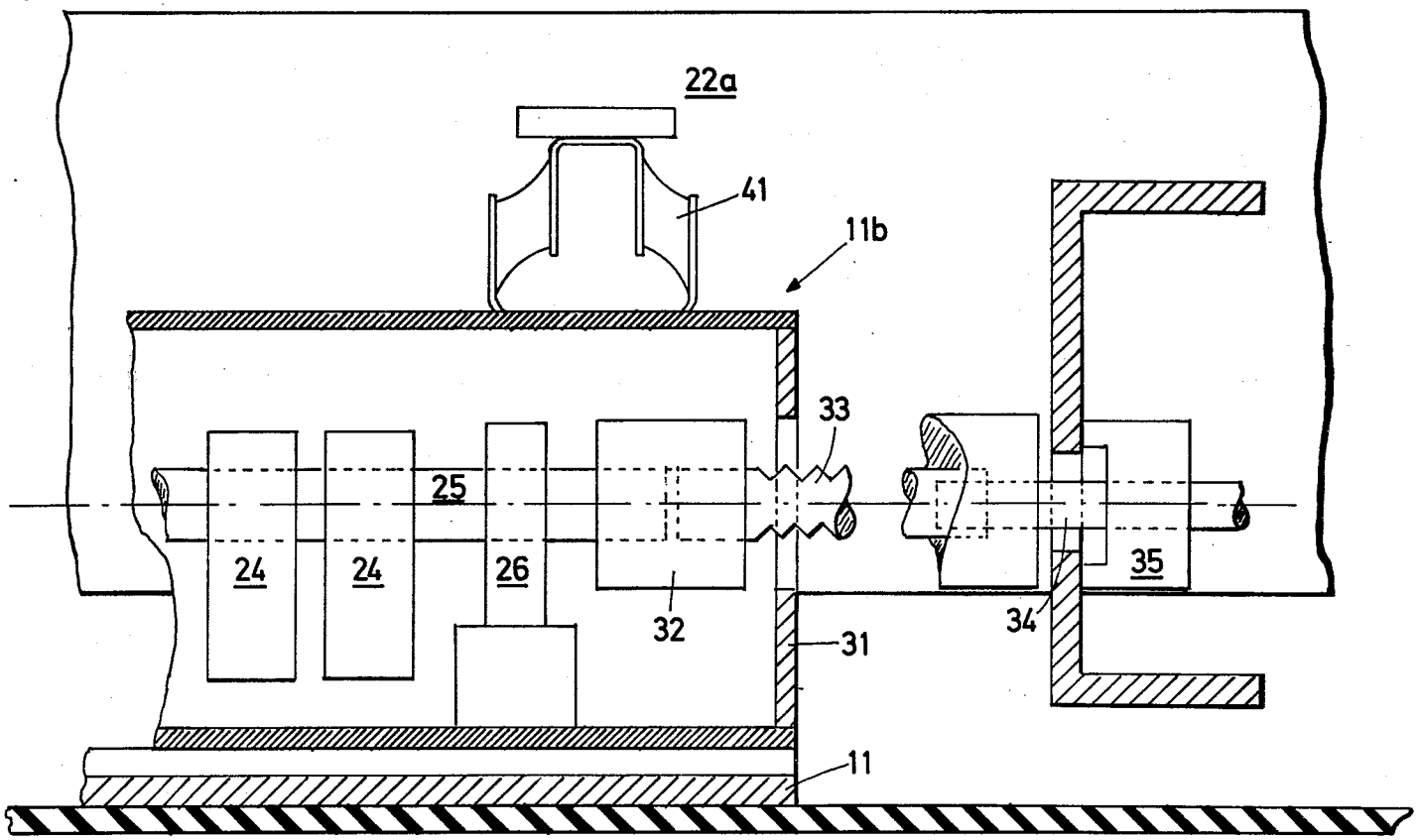
FIG. 6 is a fragmentary sectional view along the lines VI—VI of FIG. 4.

The upper side of the lower run of each of the belts 7 and 8 is supported by a support plate 11 (shown in cross section in FIG. 4). The support plate 11 is welded to the bottom (FIG. 6) of a box-like construction 11*b* carried between the pairs of beams 22*a* and 22*b* respectively by means of resilient members 41.

Figure 5:
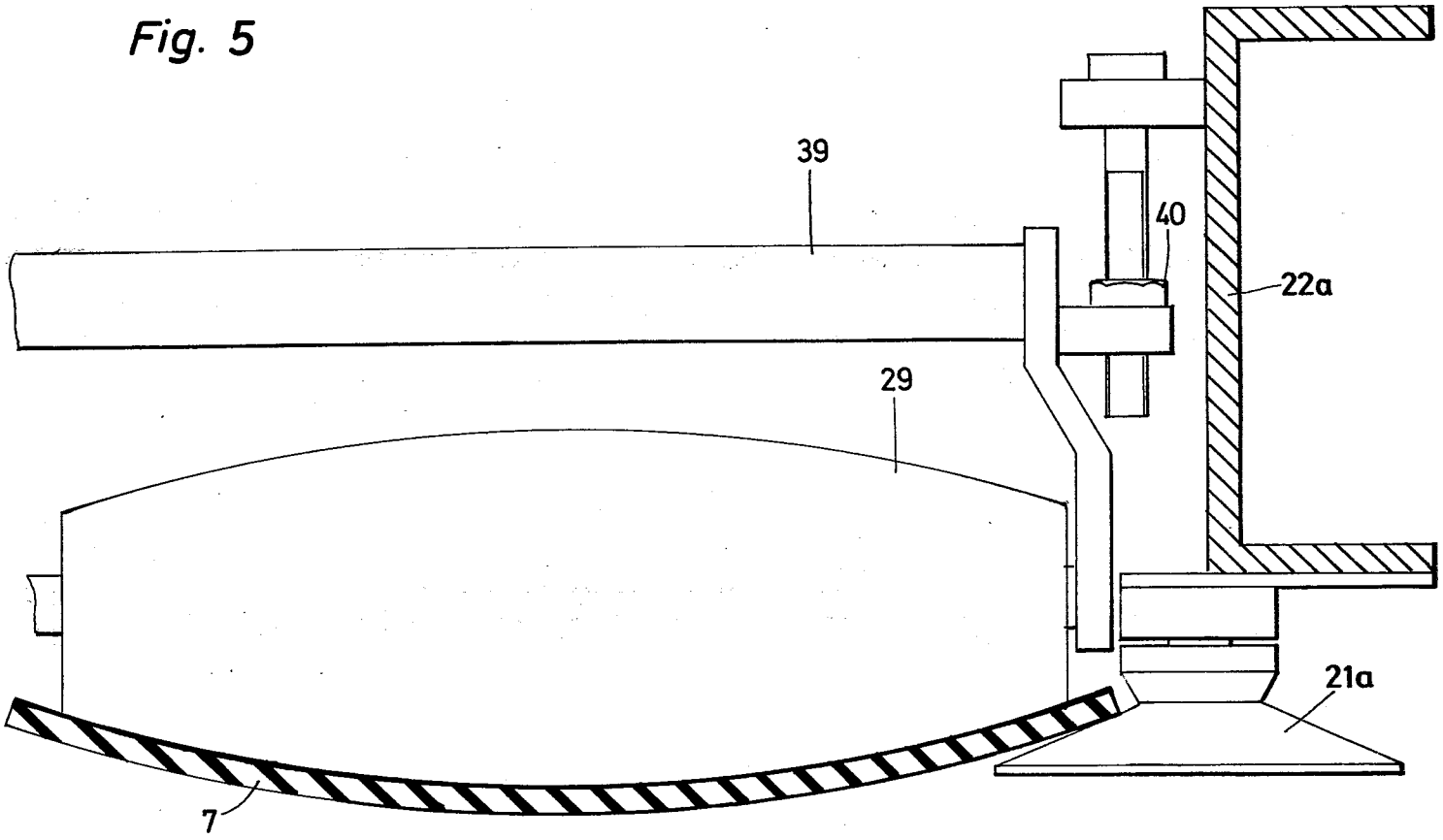
FIG. 5 is a fragmentary sectional view along the lines V—V of FIG. 3.

In order to achieve that the edge parts of each belt will engage not only the middle part of the support plate 11 but also the edge parts of the plate guide means in the form of guide rail 21 as shown in FIG. 4 or in the form of rotatable bevel dish guides 21*a* are provided at least near each end of the belt as shown in FIG. 5.

The tension of the belts may be adjusted in the usual manner by slidable mounting of the non-driven rollers 9*a* and 9*b*.

The tension of the belts, however, may also be achieved as shown in FIG. 5, where a tapered roller 29 is mounted near to each of the rollers 9*a* and 9*b* carried by a bow 39 the vertical position of which is adjustable by means of a screw 40.

At each end between the respective belt roller and support plate end tapered guide rollers 23 are mounted. The curvature of the tapered guide rollers corresponds to that of the support plates 11.

In the box-like construction 11*b* vibration means are mounted.

The vibration means comprise rotatable pie-shaped weights 24 fixed to a shaft 25 journaled in pillow blocks 26 welded to the bottom of the box-like construction 11*b*.

The shaft 25 ends near the end plate 31 of the box-like construction where the shaft end is fitted in one end of a coupling 32. In the other end of the coupling is fitted a flexible shaft 33 which extends through an opening in the end plate 31 to a flexible coupling carried on the end of a rotatable shaft which passes through a journal bearing 35 and is connected in a manner known per se to a separate drive station, e.g. an electric motor.

Further to the arrangement of the two belts 7 and 8 as just described, the framework 13 carries a hopper 16 for rendering material and a glazing plate 19.

The hopper 16 is mounted in front of the pair of beams 22*a* and has an open bottom. An inclined plate 16*a* is suspended under the hopper and in a manner known per se connected to an oscillator. The hopper wall nearest to the lower end of the inclined plate 16 is provided with a slot covered by an adjustable gate 18.

The hopper extends across the entire width of the mold frame so that when the oscillator is started rendering material from the hopper 16 will be delivered to the surface layer of the unit in the mold frame. The quantity of rendering material delivered is adjusted by means of a gate 18. If desired an adjustable oscillator may be used in which case the delivery of rendering material may be controlled by the speed or the throw of the oscillator.

The glazing plate 19 also extends across the entire width of the mold frame and is mounted in a vertically adjustable manner on beams 19*a* carried by the framework 13 behind the pair of beams 22*b*. Hand wheels 23 are provided for the vertical adjustment of the glazing plate in relation to the mold frame.

The machine is used in the following way: When a concrete mixture has been poured into the form 1*a*, during vibration by means of vibrators attached to the metal plates 6 on the bottom plate 2 of the form, and when the form is completely filled with concrete mass 1, the setting of which has just begun, the machine is moved along the rails 5 to the end of the form.

The vertical position of the belts 7 and 8 are adjusted by means of the hand wheels 20 so that the lowest part of the lower run of each of the belts just rests upon the top edges of mold end sides 3*a* and later — when the machine has been moved further — of the lateral sides 3*b*.

When the vertical position is correct, the driving motors of the belts 7 and 8 are started and if desired also the driving motors of the vibration means for the belts.

The machine is then moved on the rails 5 at a constant speed across the form with the belts constantly running in mutually opposite directions.

As only a narrow strip of each belt is touching the surface of the concrete mass, a good smoothing effect is achieved.

If the vibration means have also been started, also a compression of the surface layer will be achieved.

If desired the machine may be moved across the form a first time with only the belt running and then a second time with also the vibration means in action.

Should during one or more passages a shrinkage of the surface layer appear, then rendering material may be added from the hopper 16.

In this case the machine should be moved across the form with the hopper end first. The rendering material should be an earth-dry cement-water mixture and with one passage an added layer of at least 4 mm may be worked into the surface giving a completely smooth surface after one passage.

If a velvet surface should be desired, the glazing plate 19 is lowered by means of the handwheels to a position where it, in a manner known per se, can provide for such improvement of the surface smoothed by the belts.

Although the foregoing description has had reference to preferred embodiments of the invention, there are certain modifications, combinations and substitutions that do not depart from the true scope of the invention that will undoubtedly occur to those skilled in the art. Therefore, it is intended that the invention be limited only as defined in the appended claims.

What we claim is:

1. Machine for surface treatment of horizontally cast concrete units, such as walls, partitions, and floor decks, which are used in the erection of prefabricated houses and which are cast in mold frames having lateral boundaries, the top edges of which are flush with the upper surface of the concrete unit, the finishing being performed while the units rest in their mold frames, comprising a horizontal rectangular framework, opposed vertical supports on opposite sides of said framework, wheels mounted on said opposed vertical supports for guiding said framework for movement along parallel longitudinal tracks disposed under each of said opposed vertical supports, vertically adjustable transverse support means extending between said vertical supports, a plurality of pairs of rollers, the rollers of each pair being mounted at opposite ends of said vertically adjustable transverse support means, a plurality of parallel endless belts, each of said belts passing over one of said pairs of rollers, means mounted on said machine for driving said belts in mutually opposite directions, a mold frame mounted beneath said horizontal framework for containing a cast concrete unit to be finished, sides on said mold frame parallel to said vertical supports, said mold frame sides having a width greater than the cast concrete unit, each said belt having a lower run and an upper run, said lower run spanning at least the entire width between said mold frame sides and overlying the surface of the cast concrete unit, a pluraiity of support plate means mounted on said framework, each of said support plate means positioned above and in contact with the lower run of an endless belt to direct the respective said belt downward against the surface of the cast concrete unit, and separately driven means connected to each of said support plate means for vibrating the respective support plate means substantially perpendicular to the surface of the cast concrete unit.

2. Machine according to claim 1, in which the support plate means are curved, each support plate means having a concave face positioned above and resting upon said lower run of a said belt.

3. Machine according to claim 1 having a box-like construction suspended between the upper and lower run of each belt, said support plate means forming a bottom of said box-like construction.

4. Machine according to claim 3, in which the box-like construction is carried by resilient members mounted on the vertically adjustable transverse support means for the belt rollers.

5. Machine according to claim 4 in which guide rails are arranged along the edges of the lower runs of the belts for forcing the edges against the support plates.

6. Machine according to claim 4 in which rotatable bevel dish guides are arranged along the edges of the lower runs of the belts for forcing the edges against the support plates.

7. Machine according to claim 4 in which rotating means are mounted in the box-like construction, for providing vibrations perpendicular to the belts through the support plates.

8. Machine according to claim 1, further including a hopper mounted on the framework for supplying a rendering material or other material to the surface of the cast concrete unit, said hopper having an open channel with a discharge slot located in front of said endless belts and means for varying the width of the slot to allow a predetermined layer of the material contained in the hopper to be applied through the slot to the surface of the cast concrete.

9. Machine according to claim 1, further including a glazing plate mounted on the framework behind said endless belts, said glazing plate extending across the entire width of the panel and suspended such that it is retained with a definite pressure down against the surface of the panel.

* * * * *